US007395754B1

(12) United States Patent
Bobren et al.

(10) Patent No.: US 7,395,754 B1
(45) Date of Patent: Jul. 8, 2008

(54) QUICK ACCESS GUIDE WITH INTEGRATED STRAP CHUTE OPENER

(75) Inventors: Allan J. Bobren, Streamwood, IL (US); Wieslaw M. Smialek, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/959,790

(22) Filed: Dec. 19, 2007

(51) Int. Cl.
*B65B 13/04* (2006.01)
*B65B 13/18* (2006.01)

(52) U.S. Cl. ..... 100/26; 100/29; 53/589

(58) Field of Classification Search ..... 100/26, 100/29, 32, 33 PB; 53/589
See application file for complete search history.

(56) References Cited

U.S. PATENT DOCUMENTS 6,478,065 B1 * 11/2002 Haberstroh et al. ..... 156/443
6,857,252 B2 * 2/2005 Haberstroh et al. ..... 53/589
6,951,170 B2 * 10/2005 Lininger et al. ..... 100/26
7,263,928 B1 * 9/2007 Holden et al. ..... 100/26

* cited by examiner

*Primary Examiner*—Jimmy T Nguyen
(74) *Attorney, Agent, or Firm*—Mark W. Croll; Donald J. Breh; Levenfeld Pearlstein, LLC

(57) ABSTRACT

A quick access guide with an integrated strap chute opening device for a strapping machine is disclosed in which the strap chute separating device has a frame and a strap chute mounted to the frame. The strap chute includes at least one fixed wall cooperating with at least one movable wall. In a first position, the walls are closed and define a strap path through the strap chute and in a second position, the movable wall moves to separate and open the strap path. A handle rotates to open the chute using a cam. A guide arm is also rotated by rotation of the handle to allow access to the strap path.

20 Claims, 12 Drawing Sheets

QUICK ACCESS GUIDE WITH INTEGRATED STRAP CHUTE OPENER

BACKGROUND OF THE INVENTION

The present invention is directed to a strap chute opening device. More particularly, the present invention pertains to a quick access guide with integrated chute opener.

Strapping machines are in widespread use for securing straps around loads. One type of known strapper includes a strapping head and drive mechanism mounted within a frame. A chute is mounted to the frame and strapping material is fed through the chute.

It has been found that it is often necessary to open and hold open the strap chute to access the areas within the machine, for example, the strap guide and feed areas. This may also be necessary to dislodge misfed strap, to clear the strapping head or weld head, or for general maintenance or repair of the machine. Quite often, it is necessary to access the strap path by moving or widening the strap chute at or near the weld head.

Previous strap chute opening devices had handles rigidly mounted to the strap guide. The strap chute would be opened by external means using a hook or "walk-up" or using a "pass-through" wherein a spring-actuated lever is held down when the table top is closed. Current chute opening devices require intimate knowledge of the machine to place the machine in service mode in order to access the strap path and perform any maintenance operations.

Accordingly, there is a need for a device which allows quick access to the trap path in a strapping machine without need for complicated steps to place the device in a service mode. Desirably, such a quick access mechanism is easy to operate and involves relatively few parts and steps. More desirably, the device does not require intimate knowledge of the strapping machine, either to place the device in service mode or to return the device to normal operation.

BRIEF SUMMARY OF THE INVENTION

An integrated strap chute opening device with quick access guide for a strapping machine is disclosed. The strapping machine has a frame and a strap chute mounted to the frame. The strap chute includes at least one fixed wall cooperating with at least one movable wall. In a first position, the walls are closed and define a strap path through the strap chute. In a second position, the movable wall moves to separate and open the strap path. A handle is positionable in at least three positions and rotates to open the strap chute using a cam or cam surface. A guide arm is also opened by movement of the handle and is moved by the handle to allow access to the strap path.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
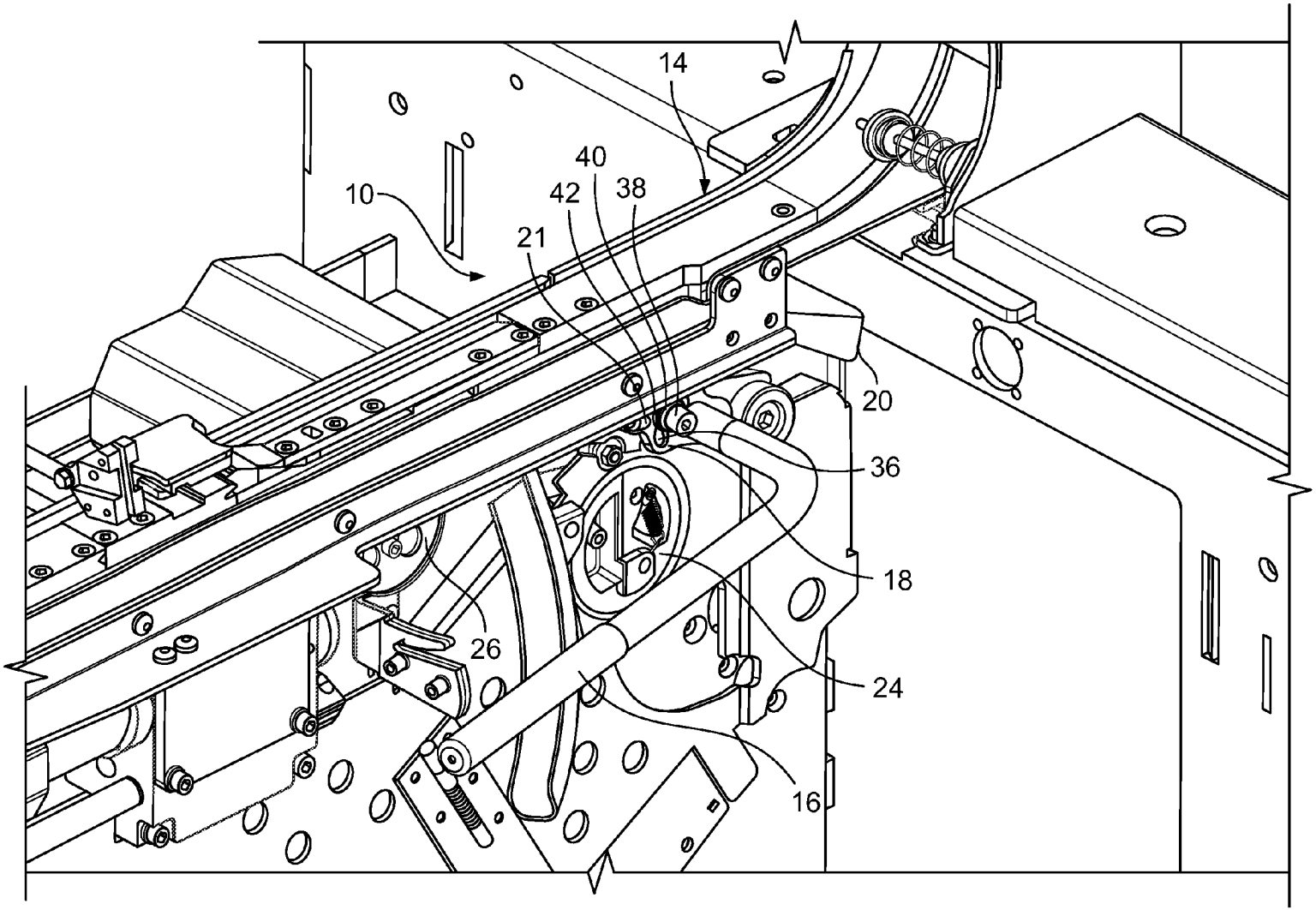
FIG. 1 is a perspective view of an integrated strap chute opening device with quick access guide embodying the principles of the present invention, shown with the handle of the quick access guide mechanism in a first position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown generally a strapping machine with the quick access guide mechanism 10 embodying the principles of the present invention. The strapping machine is of the type configured to feed a strapping material around a load, and position, tension, and seal the strapping material around the load. The strapping machine includes the strap chute 14 for carrying the strap around the load and for releasing the strap material S from the strap chute 14.

The strapping machine includes, generally, a frame 12 and a strap chute 14; the quick access guide and chute opener 10 includes a quick access handle 16, a cam 18 and a cam section 20. A portion of the feed system includes a lower strap guide 32, and an upper strap guide 34. A strap supply or dispenser (not shown) supplies strapping material S to the strapping machine. A winder 24 and a feed reel 26 work to feed and retract the strap S, and to adjust the strap S tension during operation of the strapping machine.

The strap chute 14 is formed having a chute frame 13 with a fixed wall 28 and an inner, movable wall 30 defining a track for conveying the strap through the strap chute 14. The inner wall 30 is movable relative to the fixed wall 28. The inner wall 30 is parallel to the longitudinal axis between an operating position and a release position of the strap chute 22. The fixed wall 28 is transverse to the longitudinal axis between an operating position and a release position of the strap chute 22. The inner wall 30 is biasedly mounted to the chute frame 13.

The strap path 22, in which the strap or strapping material S moves, is partially defined by and exists between the fixed wall portion 28 and the inner, movable wall portion 30. In the present quick access guide, the strap path 22 is widened to allow a user to access the strap path 22 as well as other areas of the machine below the path 22, such as the strapping head and guide 32, 34 areas. To widen the strap path 22 gap, the movable portion 30 moves transverse to the plane of the strap path 22 and away from the fixed portion 28 by actuation of the quick access handle 16 and a cam section 20.

Figure 4:
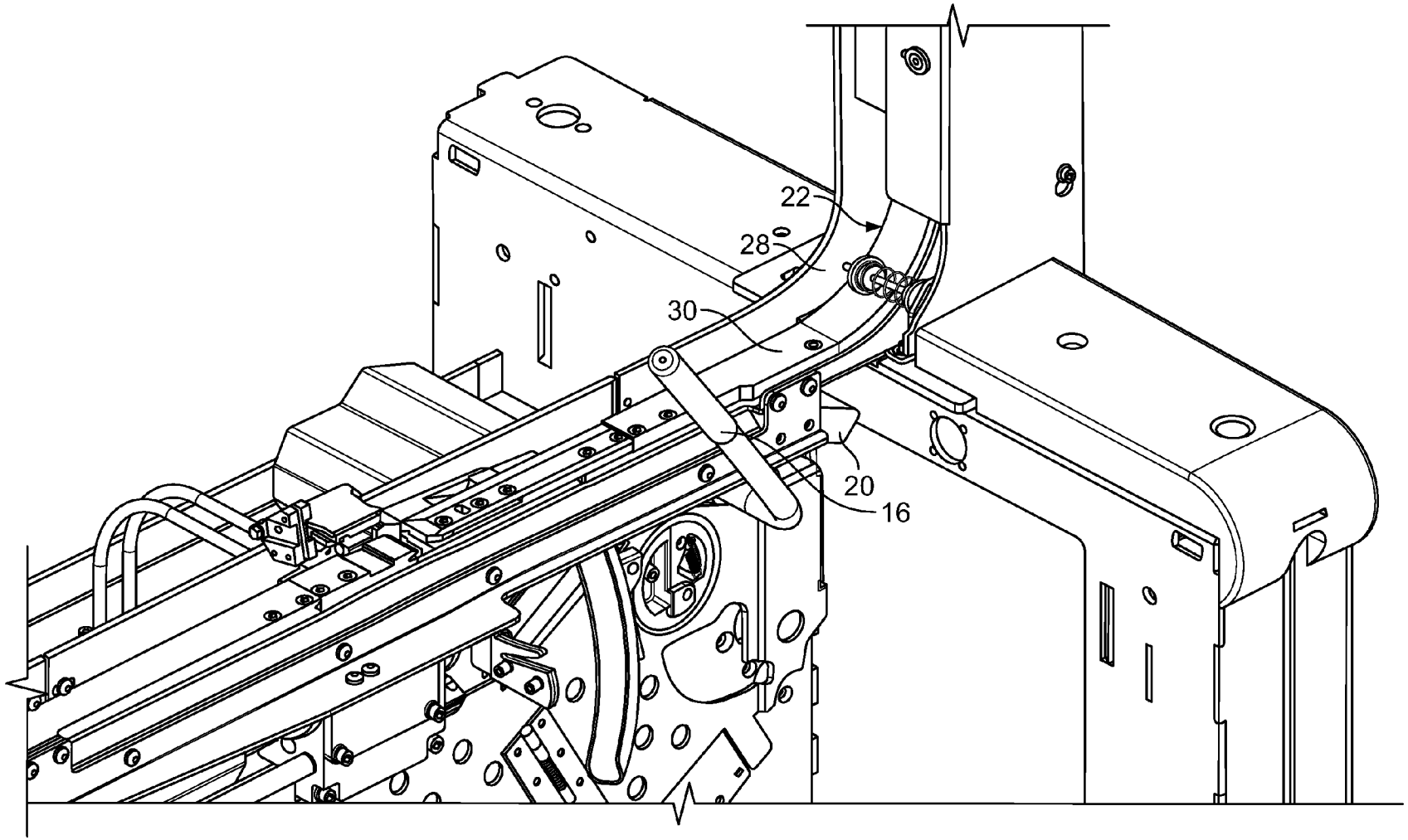
FIG. 4 is a perspective view showing the chute opening device with the handle in a second position.
Figure 5:
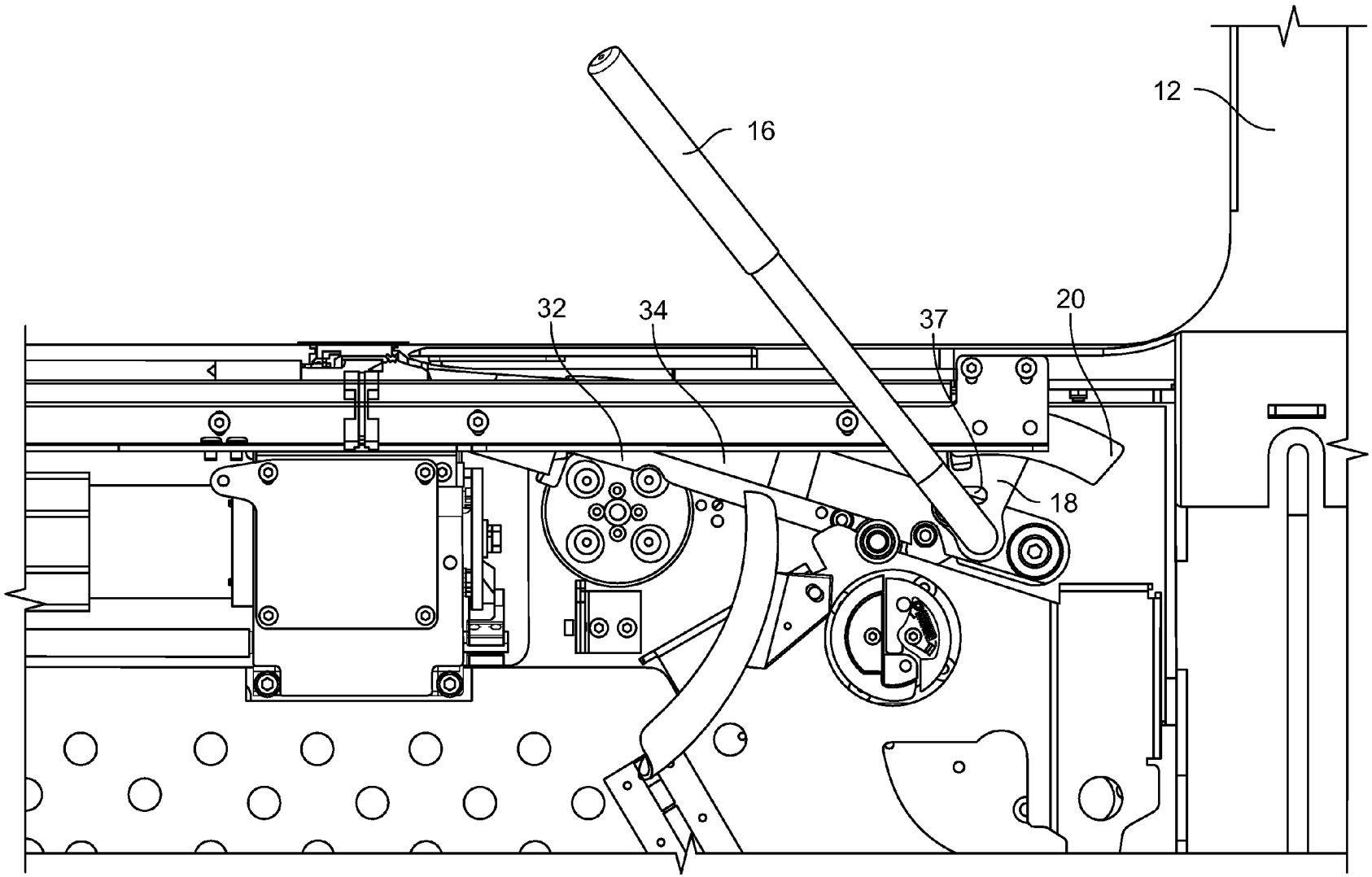
FIG. 5 is a side view showing the handle in the second position.
Figure 6:
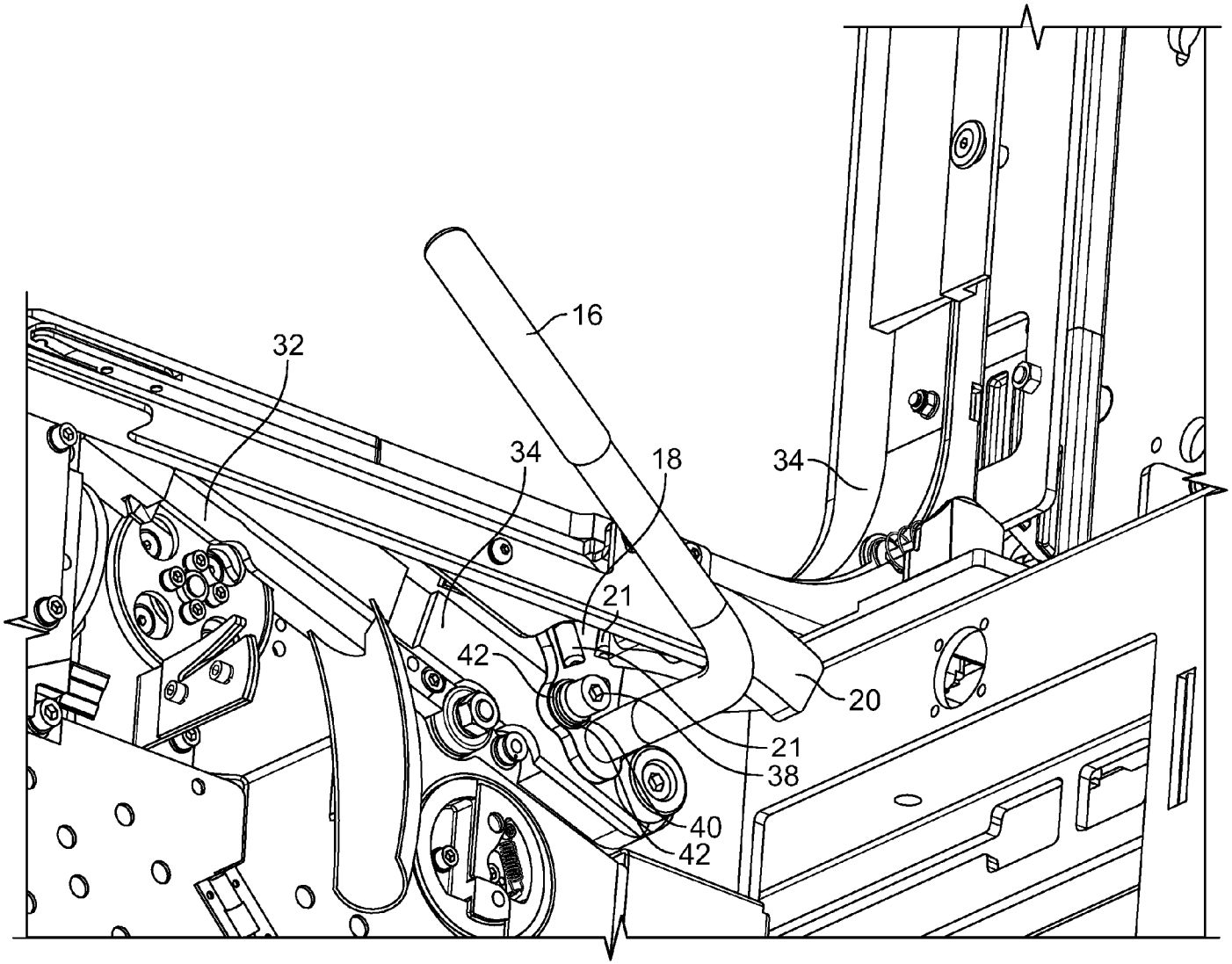
FIG. 6 is a perspective view showing the handle in the second position.

The strap path 22 is further defined by an upper guide arm 34 that is movable with respect to a fixed lower guide arm 32. The upper movable guide arm 34 rests on the lower fixed guide arm 32 when the handle 16 is in first and second positions, as shown in FIGS. 1 and 4 respectively. The upper guide arm or portion 34 resides over the feed wheel 26 and, when closed (relative to the lower guide arm 32) provides a path for the strap fed into the machine (to the strapping head and strap chute). At times, access is needed to the space between the arms 32, 34 and to the area in and around the feed wheel 26.

The quick access handle 16 actuates the opening of the strap chute and access to the space between arms 32, 34 and the area around the feed wheel 26. The quick access handle 14 actuates opening of the chute 14 using a cam surface 20 and fixed pins or cam rollers 21. The fixed pins or cam rollers 21 are located on the cam plate 18 and the cam surface 20 is operably attached to the movable portion 30 of the chute. The cam plate 18 attached to the quick access handle 16 rotates and drives the cam rollers 21 against the cam surface 20. The cam plate 18 and the handle 16 are attached to the guide 34 by a washer, in this instance a spring washer 40, pressing against a thrust washer 42 which slides against the guide 34. The chute 14 opens sufficiently far enough to allow the guide 34 to rotate up without obstruction.

Figure 2:
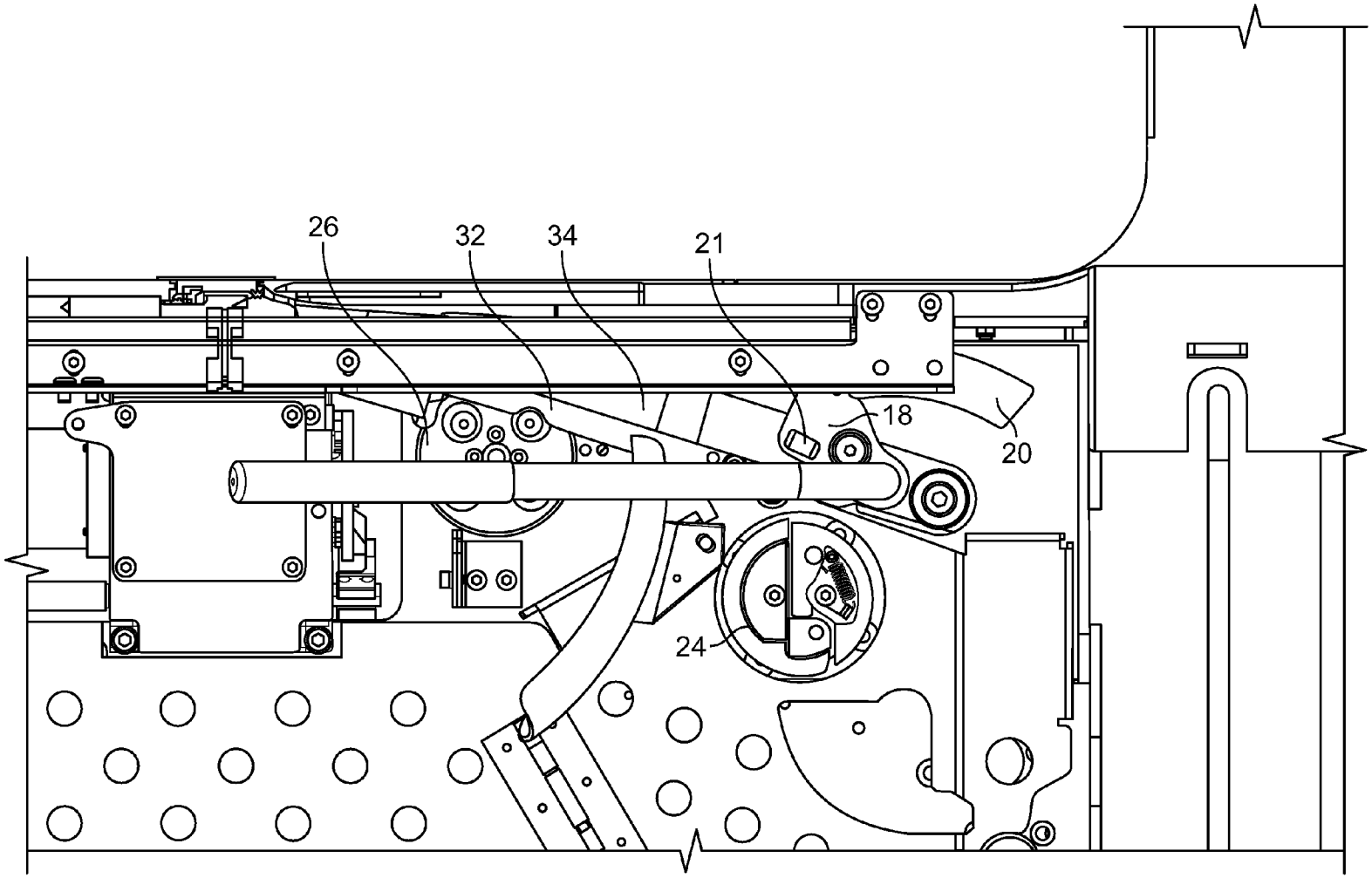
FIG. 2 is a side view showing the handle in the first position.
Figure 3:
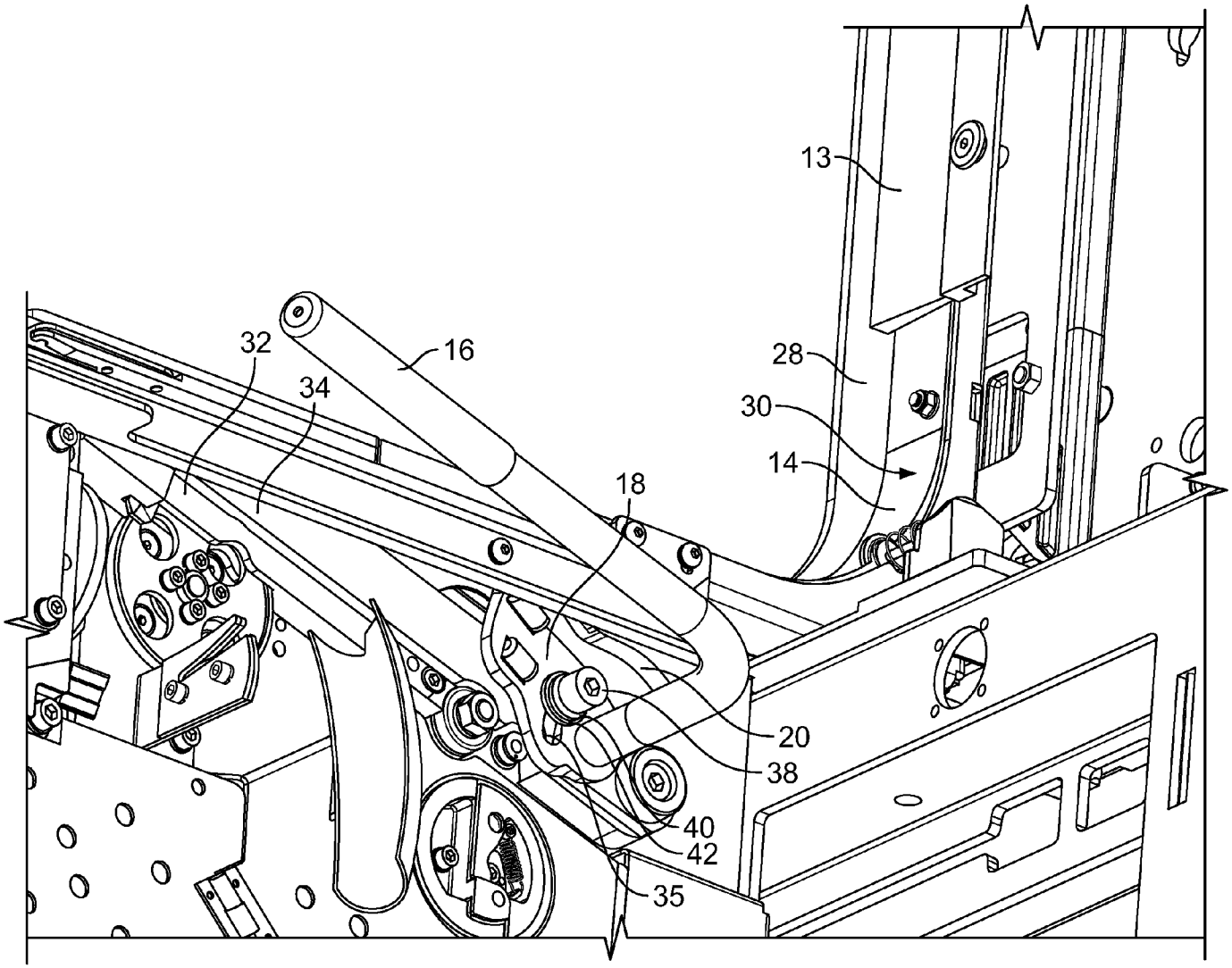
FIG. 3 is a perspective view showing the handle in the first position.

In the first position, as shown in FIGS. 1-3, the handle 16 is positioned such that the strap path 22 is closed, the movable portion 30 is adjacent to/close to the fixed portion 28, and the upper guide arm 34 is down and located beneath the moveable portion 30. The pin 38 is positioned within the slotted opening 36 in a first pin position. This is the machine's normal operating position.

In FIGS. 4-7, the quick access handle 16 is rotated to a second position. The cam plate 18 moves with the actuation of the quick access handle 16 so that the pin 38 slides within the slotted opening 36 to a second pin position. The cam rollers 21 slide under cam 20 and between the movable 30 and fixed 28 portions of the strap chute 22. The strap path 22 is urged open by cam action on the movable portion 30 by section 20. The movable portion 30 moves away from the fixed portion 28, in a direction transverse to the plane of the strap path 22 to open a gap between the movable 30 and fixed 28 portions. The upper guide arm 34 is no longer inhibited by the movable portion 30, but remains in the down or closed position when the quick access handle 16 is in second position.

Figure 7:
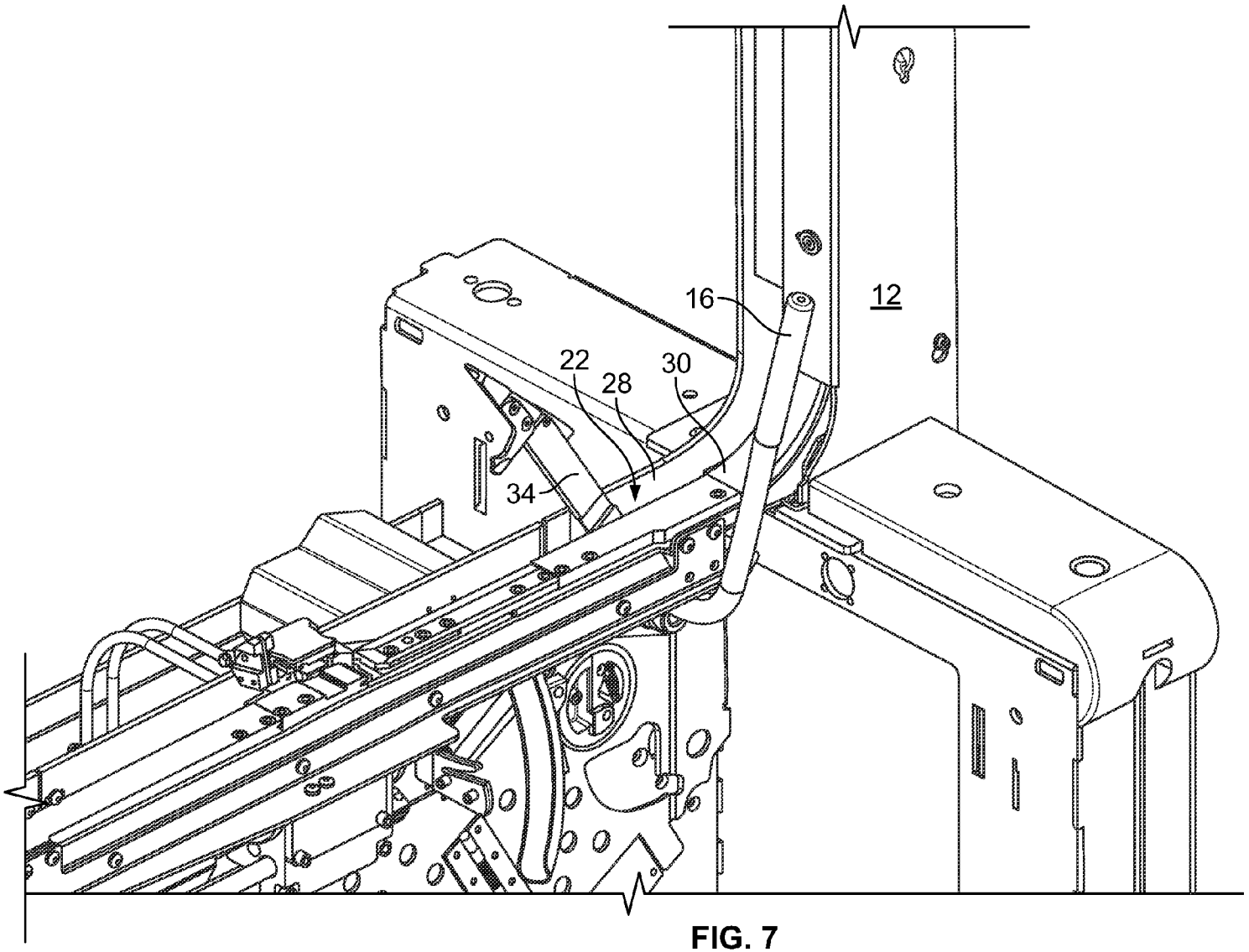
FIG. 7 is a perspective view showing the handle in a third position.

Movement by the upper guide arm 34 is no longer blocked by the moveable wall portion 30 when the quick access handle 16 is in second position. As the quick access handle 16 moves/rotates from second position to third position, as illustrated in FIG. 7, the cam plate 18 turns as well. The quick access handle 16 rotates from second position to third position and the pin 38 is inhibited from sliding further along the slotted opening 36 of the cam 18. The pin 38, no longer able to slide in the slotted opening 36 and fixedly attached to the upper guide arm 34 engages the end 35 of the slotted opening 36, and force the upper guide arm 34 to follow the quick access handle 16 as the handle 16 moves from second position to third position. Accordingly, the upper guide arm 34 is rotated into an upright (open) position. Simultaneously, the cam plate 18 remains situated such that the strap path 22 remains open/widened, with the movable portion 30 held away/separated from the fixed portion 28. The widening of the strap path 22 and the raising of the upper guide arm 34 allows the strap path 22 and guide arms 32, 34 areas, including the strapping head and feed wheel 26, to be accessible to the user.

Figure 8:
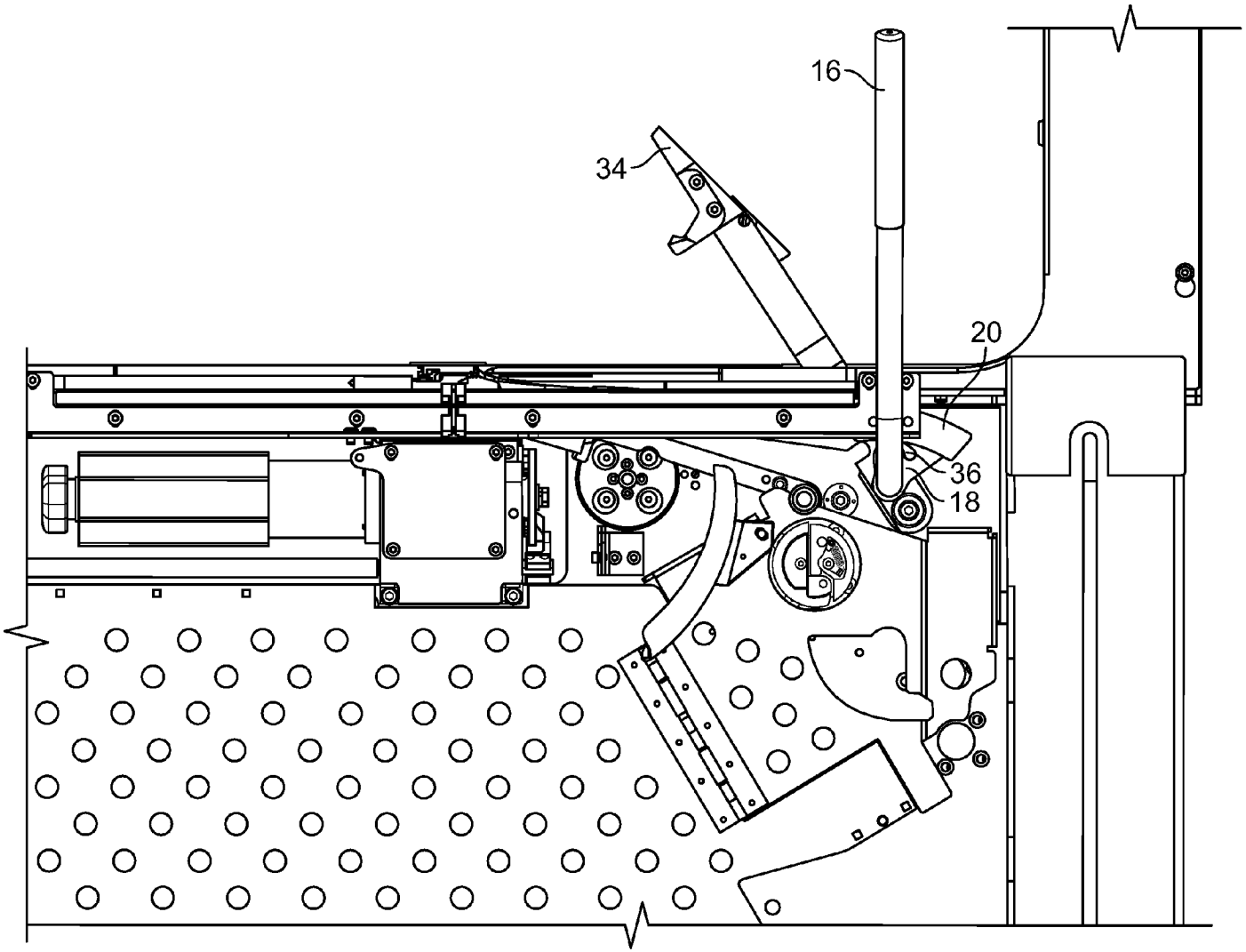
FIG. 8 is a side view showing the handle in the third position.
Figure 9:
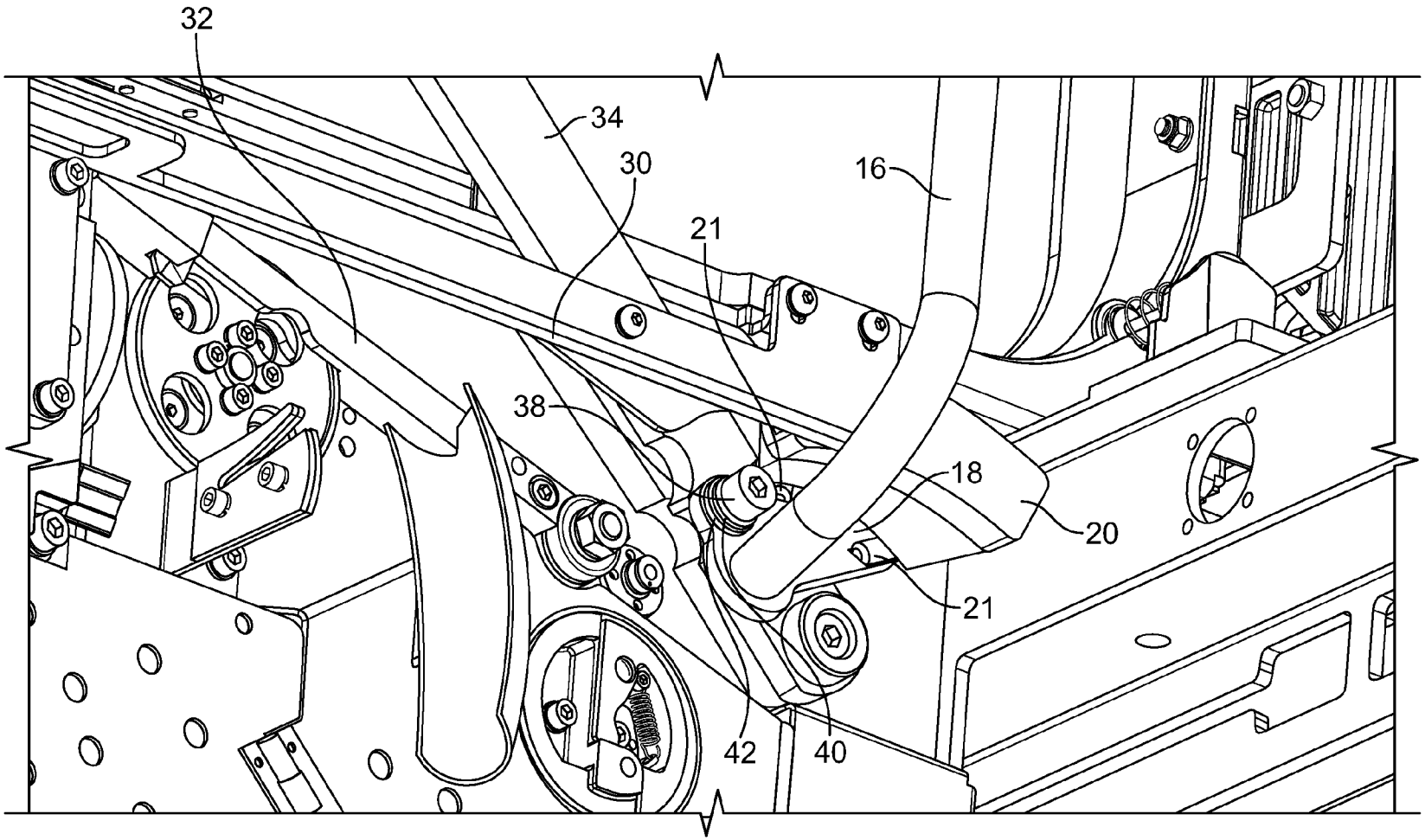
FIG. 9 is a perspective view showing the handle in the third position.

When the quick access handle 16 is raised fully, the slot 36 in the cam plate 18 bottoms against the shoulder bolt or guide pin 38 in the guide 34. The quick access guide 34 is pulled open when the shoulder bolt/guide pin 38 is engaged and the handle 16 is opened fully, in position 3, as shown in FIGS. 7-9.

Closing the strap path 22 to return the strap machine to operational configuration is easily accomplished. When closing the handle 16, in other words, going from position 3 to position 1, the guide pin 38 contacts the opposite end 37 of the slotted opening 36. There is sufficient drag created between the Bellville washer 40 and the handle 16 so that the guide 34 moves with the handle 16. The guide 34 moves with the handle 16 until it is inside the gap created between the fixed wall 28 and the movable wall 30, into second position, as shown in FIGS. 4-7. Further rotation of the handle 16 moves the cam section 20 and movable chute portion 30 out of engagement with the cam plate 18, causing the slotted opening 36 in the cam plate 18 to drive against the shoulder bolt 38 and push the guide 34 into the closed position, normal operating position, position 1, as shown in FIGS. 1-3. The spring force of the chute's movable portion 30 closes the strap chute 12, positioning it in the normal operating position, position 1. The movement of the handle 16 can be either step-like or one smooth integrated movement. Importantly, no intimate knowledge of machine conversion is necessary to return the strapping machine to normal operating condition from a service mode.

Figure 10:
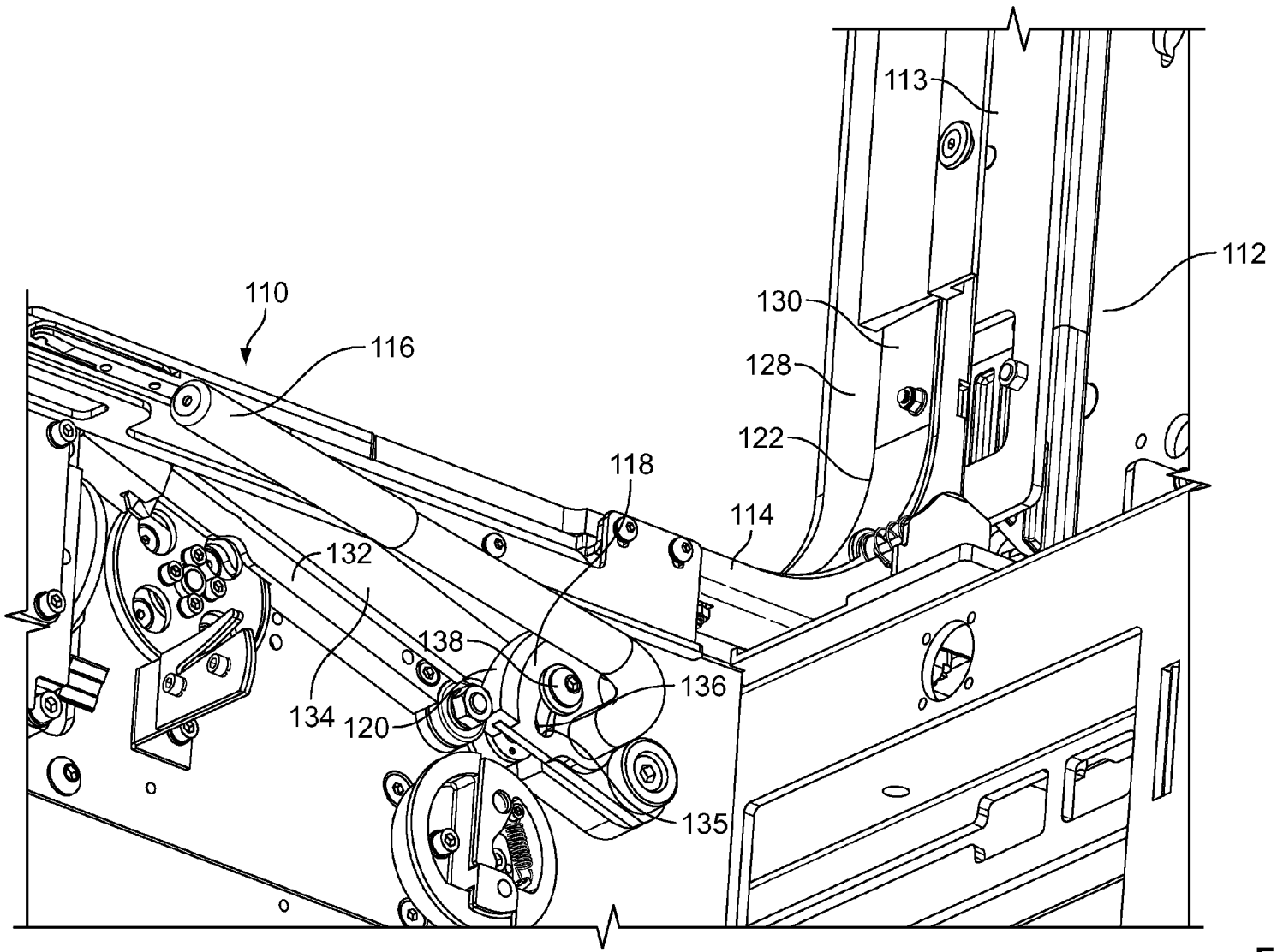
FIG. 10 is a perspective view showing an alternate embodiment of the chute opening device with quick access guide with the handle in the first position.
Figure 11:
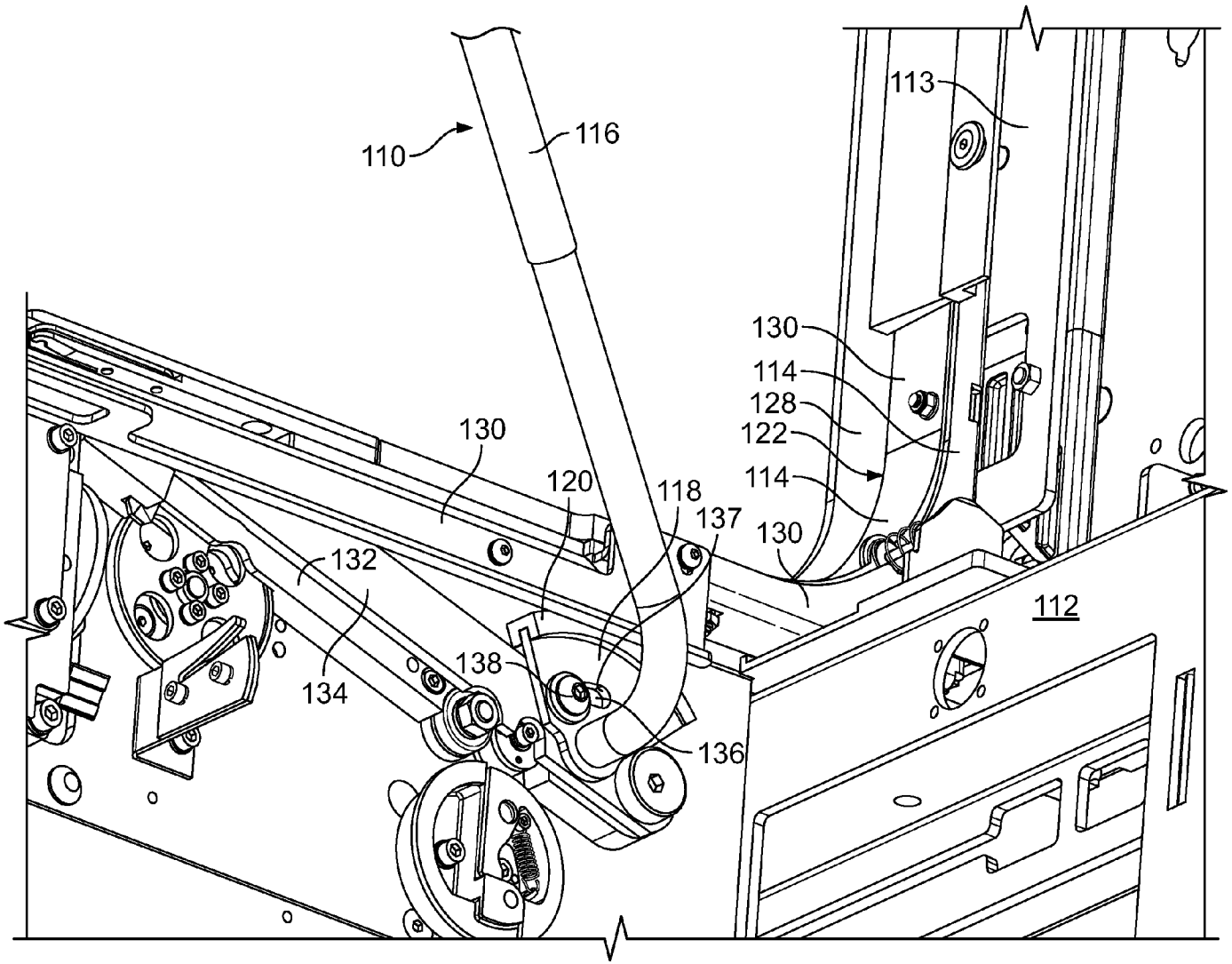
FIG. 11 is a perspective view showing the alternate embodiment with the handle in the second position.
Figure 12:
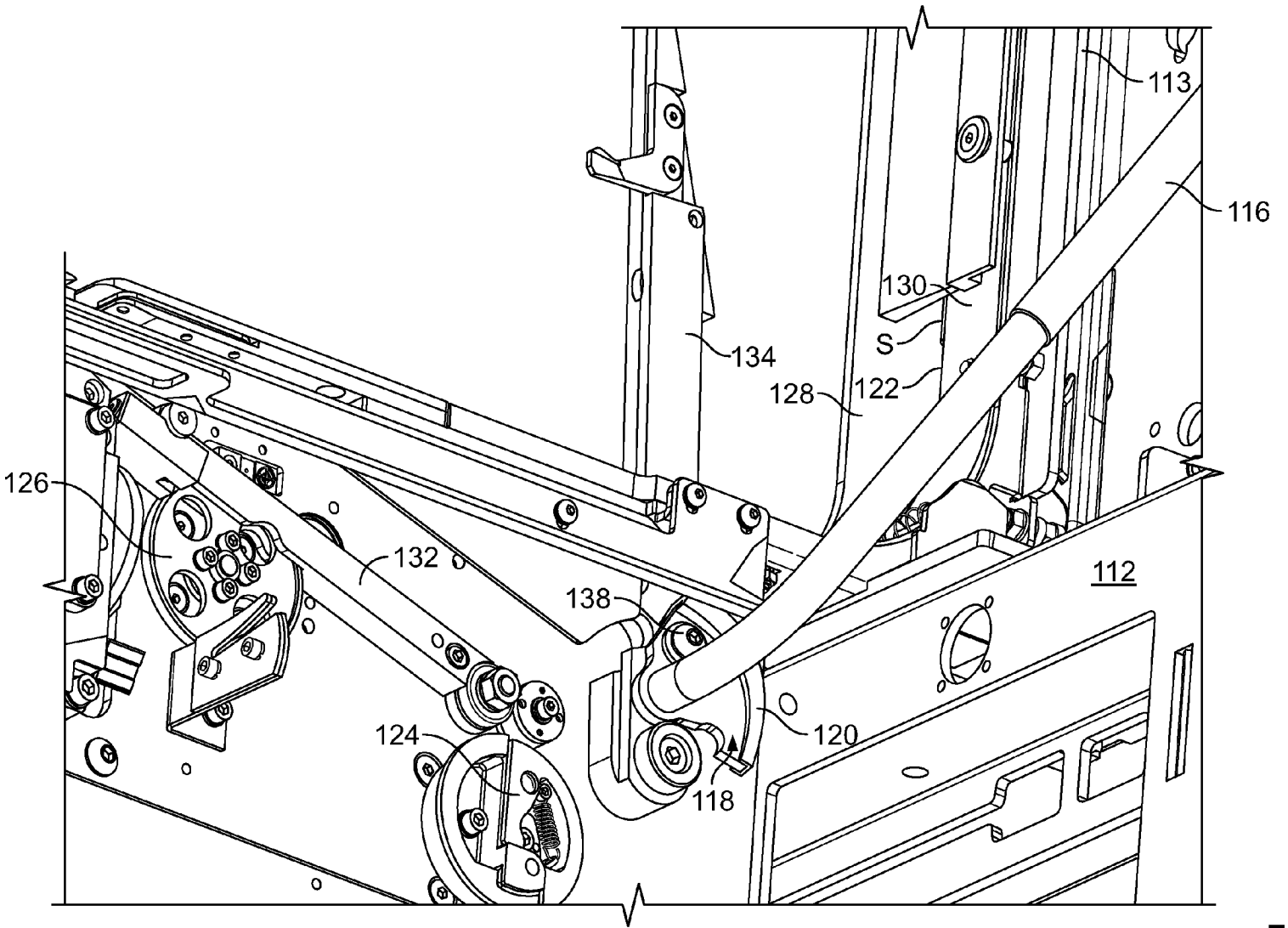
FIG. 12 is a perspective view showing the alternate embodiment with the handle in the third position.

In another embodiment 110 including a chute frame 113 and a winder 124, as shown in FIGS. 10-12, the cam plate 118 and handle 116 are pivotally mounted to the machine and can be mounted to a side of the guide arm 134. The cam plate 118 is formed with a slotted opening 136. The slotted opening 136 engages a pin or bolt 138 that is connected to the upper arm 134. The cam section 120 is located along an edge of cam plate 118 and resembles a wedge-shaped or sloping surface. The cam section 120 has a slope defining a path on which the movable portion 130 rides during opening/widening of the strap path 122. The handle 116 actuates the opening/widening of the strap path 122 and the raising and lowering of the upper guide arm 134 using a three stage movement, similar to that of the first embodiment.

In a first position, the handle 116 and the upper guide portion 134 are down and the strap path 122 is closed. As the handle 116 is moved from a first position, as shown in FIG. 10, to a second position, as shown in FIG. 11, the cam plate 118 rotates and the cam surface 120 moves between the fixed wall 128 and the movable wall 130, widening the space between the movable 130 and fixed 128 walls. In the second position, the upper guide portion 134 is still in a closed or down position.

As the handle 116 rotates from the second position to a third position, as shown in FIG. 12, the cam plate 118 turns as well. The quick access handle 116 rotates from second position to third position and the pin 138 is inhibited from sliding further along the slotted opening 136 of the cam 118. The pin 138, no longer able to slide in the slotted opening 136 and fixedly attached to the upper guide arm 134 engages the end 135 of the slotted opening 136, and forces the upper guide arm 134 to follow the quick access handle 116 as the handle 116 moves from second position to third position. Accordingly, the upper guide arm 134 is rotated into an upright (open) position. Simultaneously, the cam plate 118 remains situated such that the strap path 122 remains open/widened, with the movable portion 130 held away/separated from the fixed portion 128. The widening of the strap path 122 and the raising of the upper guide arm 134 allows the strap path 122 and guide arms 132, 134 areas, including the strapping head and feed wheel 126, to be accessible to the user.

Closing the strap path 122 to return the strap machine to operational configuration is easily accomplished. The handle 116, now in the third position, is rotated/moved to second position, thus lowering the upper guide arm 134 into its original position, resting on the lower guide arm 132. When closing the handle 116, the guide pin 138 contacts the opposite end 137 of the slotted opening 136 and there is sufficient drag created so that the guide 134 moves with the handle 116. The guide 134 moves with the handle 116 until it is inside the gap created between the fixed wall 128 and the movable wall 130, into second position, as shown in FIG. 11. Further rotation of the handle 116 moves the cam section 120 and movable chute portion 130 out of engagement with the plate 118. The spring force of the chute's movable portion 130 closes the strap chute 112, positioning it in the normal operating position, position 1, as shown in FIG. 10.

Returning the handle 116 to first position allows the strapping machine to resume normal operation. The movement of the handle 116 can be either step-like or one smooth integrated movement. Importantly, no intimate knowledge of machine conversion is necessary to return the strapping machine to normal operating condition from a service mode.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitations with respect to the specific embodiments illustrated is intended or should be inferred. The disclosure is intended to cover by the appended claims all such modifications as fall within the scope of the claims.

What is claimed is:

1. A quick access guide with integrated strap chute opening device for a strapping machine, the strapping machine configured to feed a strapping material around a load, and position, tension and seal the strapping material around the load, the strapping machine having a frame, a strap chute mounted to the frame including at least one fixed wall cooperating with at least one movable wall to define a strap path through the strap chute through which strap is conveyed and from which strap is pulled onto the load, the strapping machine including a strap guide through which strap is conveyed to the strap chute, the strap guide is positioned under the strap chute, the strap guide including a fixed portion and a movable portion, movable toward and away from the fixed portion to open and close the strap guide, respectively, the opening device comprising:

a cam surface mounted to the strap chute movable wall;

a handle operably connected to the strap guide movable portion;

a cam plate operably mounted to the handle and the strap guide movable portion, the cam plate having a cam element thereon;

a guide pin mounted to the strap guide movable portion and engageable with the cam plate, wherein the handle is movable from a first position in which the cam plate element is out of engagement with the cam surface and the strap guide is closed and the strap chute is closed, to a second position in which the cam element engages the cam surface to move the strap chute movable wall away from the strap chute fixed wall, to a third position in which the cam element is maintained in engagement with the cam surface and the cam plate engages the guide pin to move the strap guide movable portion into an upright position to open the strap guide.

2. The opening device in accordance with claim 1 wherein the handle is movable continuously through the first, second and third positions.

3. The opening device in accordance with claim 1 wherein the guide pin is disposed in a slotted opening in the cam plate, and wherein the guide pin is engaged by an end of the slotted opening to move the strap guide movable portion to an open position.

4. The opening device in accordance with claim 1 wherein the cam plate is pivotable about a pivot axis of the handle.

5. The opening device in accordance with claim 3 wherein the guide pin is a bolt extending through the slotted opening and includes a biasing element to maintain friction on the cam plate.

6. The opening device in accordance with claim 5 wherein the biasing element is a spring.

7. The opening device in accordance with claim 6 wherein the spring is a spring washer.

8. The opening device in accordance with claim 1 wherein the cam element is a roller cam.

9. The opening device in accordance with claim 1 wherein the cam plate further includes a second cam element.

10. The opening device in accordance with claim 9 wherein the two cam elements are roller cams.

11. The opening device in accordance with claim 1 wherein the cam element is a ramped surface.

12. The opening device in accordance with claim 1 wherein the cam element is a pin embedded in the cam plate.

13. The opening device in accordance with claim 11 wherein the ramped surface extends along an edge of the cam plate.

14. A strapping machine of the type for feeding a strapping material around a load, and positioning, tensioning and sealing the strapping material around the load, comprising:

a frame;

a strap chute mounted to the frame including at least one fixed wall cooperating with at least one movable wall to define a strap path through the strap chute through which strap is conveyed and from which strap is pulled onto the load, the strap chute movable wall including a cam surface mounted thereon;

a strap guide through which strap is conveyed to the strap chute, the strap guide is positioned under the strap chute, the strap guide including a fixed portion and a movable portion, movable toward and away from the fixed portion to open and close the strap guide, respectively; and a quick access guide with integrated strap chute opening device including a handle operably connected to the strap guide movable portion, a cam plate operably mounted to the handle and the strap guide movable portion, the cam plate having a cam element thereon and a guide pin mounted to the strap guide movable portion and engageable with the cam plate, wherein the handle is movable from a first position in which the cam plate element is out of engagement with the cam surface and the strap guide is closed and the strap chute is closed, to a second position in which the cam element engages the cam surface to move the strap chute movable wall away from the strap chute fixed wall, to a third position in which the cam element is maintained in engagement with the cam surface and the cam plate engages the guide pin to move the strap guide movable portion into an upright position to open the strap guide.

15. The strapping machine in accordance with claim 14 wherein the handle is movable continuously through the first, second and third positions.

16. The strapping machine in accordance with claim 14 wherein the guide pin is disposed in a slotted opening in the cam plate, and wherein the guide pin is engaged by an end of the slotted opening to move the strap guide movable portion to an open position.

17. The strapping machine in accordance with claim 16 wherein the guide pin is a bolt extending through the slotted opening and includes a spring washer disposed between the bolt and the cam plate to maintain friction on the cam plate.

18. The strapping machine in accordance with claim 14 wherein the cam element is a roller cam.

19. The strapping machine in accordance with claim 14 wherein the cam plate further includes a second cam element.

20. The strapping machine in accordance with claim 14 wherein the cam element is a fixed pin embedded in the cam plate.

* * * * *